US012545543B2

(12) United States Patent
Haapanen et al.

(10) Patent No.: US 12,545,543 B2
(45) Date of Patent: Feb. 10, 2026

(54) SLITTER-WINDER AND A METHOD FOR SLITTING AND WINDING A FIBER WEB

(71) Applicant: Valmet Technologies, Inc., Espoo (FI)

(72) Inventors: Jaakko Haapanen, Järvenpää (FI); Mikko Rämä, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 233 days.

(21) Appl. No.: 18/402,486

(22) Filed: Jan. 2, 2024

(65) Prior Publication Data

US 2024/0217767 A1 Jul. 4, 2024

(30) Foreign Application Priority Data

Jan. 4, 2023 (FI) ..... 20235009

(51) Int. Cl.
*B65H 19/18* (2006.01)

(52) U.S. Cl.
CPC ..... *B65H 19/18* (2013.01); *B65H 2301/4148* (2013.01); *B65H 2301/4617* (2013.01); *B65H 2301/5155* (2013.01)

(58) Field of Classification Search
CPC .... B65H 19/18; B65H 19/20; B65H 19/2284; B65H 2301/4148; B65H 2301/4617; B65H 2301/5155
See application file for complete search history.

(56) References Cited

U.S. PATENT DOCUMENTS 4,422,588 A * 12/1983 Nowisch ..... B26D 1/225 242/532.3
5,772,150 A * 6/1998 Spatafora ..... B65H 19/1863 242/554.6
6,701,992 B1 3/2004 Pasquale et al.
7,147,737 B2 * 12/2006 Rassl ..... B65B 9/026 156/159
2003/0178523 A1 9/2003 Trutschel
2014/0138471 A1 * 5/2014 Daul ..... B65H 26/00 242/525

FOREIGN PATENT DOCUMENTS

WO 2010000944 A2 1/2010
WO 2010052373 A1 5/2010

OTHER PUBLICATIONS

Finnish Patent and Registration Office Search Report for FI 20235009 dated Jun. 30, 2023.
Extended European Search Report for EP23209631 dated May 27, 2024.

* cited by examiner

*Primary Examiner* — Sang K Kim
(74) *Attorney, Agent, or Firm* — Stiennon & Stiennon

(57) ABSTRACT

A slitter-winder for fiber webs has an unwinding section (10), a slitting section (20) and a winding section (30) and is configured to unwind, slit and wind a thick fiber web having a basic weight of at least 200 g/m$^2$ to customer rolls (33). The unwinding section (10) has a first unwinder (11) and a second unwinder (12) for unwinding the thick fiber web from a parent roll of full-width thick fiber web (W11, W12), and a joining device (16, 17) for joining a beginning end of a thick fiber web (W11) coming from a parent roll in the first unwinder to an end of a thick fiber web (W12) coming from a parent roll in the second unwinder by forming a joint (J). The winding section (30) has a cutting device (35) for cutting and removing joint part(s) of the thick fiber web from the winding section (30).

20 Claims, 7 Drawing Sheets

SLITTER-WINDER AND A METHOD FOR SLITTING AND WINDING A FIBER WEB

CROSS REFERENCES TO RELATED APPLICATIONS

This application claims priority on FI 20235009, filed Jan. 4, 2023, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In general, the present invention relates to production of fiber webs, in particular to producing of thick fiber webs such as pulp webs. More especially the present invention relates to slitter-winders configured to unwind, slit and wind a thick fiber web to customer rolls and a method for slitting and winding a fiber web.

As known, fiber webs, also thick fiber webs, are manufactured in machines together forming a fiber web manufacturing line, which may be hundreds of meters long. Fiber webs, especially paper and board are available in a wide variety of types and can be divided according to basis weight in two grades: papers with a single ply and a basis weight of 25-300 g/m$^2$ and boards manufactured in one- or multi-ply technology and having a basis weight of 150-600 g/m$^2$. It should be noted that the borderline between paper and board is flexible since board grades with lightest basis weights are lighter than the heaviest paper grades. Generally speaking, paper is used for printing and board for packaging. Thick fiber webs are generally considered to comprise pulp webs and thick board webs. The density of a pulp web is about 400-800 kg/m$^3$ and the thickness of the pulp web is about 0.5-2.5 mm. Thick board webs typically have a thickness of at least 0.3 mm.

In fiber web production lines, manufacturing operates as a continuous process. The finished fiber web being output from the fiber web production line is wound with a reel-up around a reeling shaft, i.e. a reel spool, into a parent roll (a machine roll). The purpose of the reeling is to transfer the fiber web from its planar manufacturing form into a form in which it can be handled more easily. The reel-up is thus a device that reels a material, which is produced as a continuous fiber web in a fiber web production line, into the form of a roll; the parent roll. In the production process of the fiber web, the reeling is generally a first process part, wherein a continuous process is discontinued to be continued in sequences. The parent roll is formed around the reeling shaft that functions as a core of reeling, i.e. the fiber web on one parent roll around one reeling shaft has a beginning end and an end.

The fiber web of the parent roll generated during manufacture is full-width and long, so it must be slit and cut into partial webs of a suitable width and length for customers and wound around cores into "customer rolls" before dispatch to customers. As known, this slitting and winding of the web takes place in a separate machine fitted to the purpose, i.e., in a slitter-winder, which comprises an unwinding section, a slitting section and a winding section. In the slitter-winder the parent roll is unwound in an unwinding station of the unwinding section off the reeling shaft and the fiber web is slit with slitting blades of the slitting section into a number of narrower partial webs, which are wound in a winder of the winding section around winding spools such as cores into the customer rolls. When the customer rolls are ready, the slitter-winder is stopped and the rolls, or "set", is removed from the machine. After this, the process continues with the winding of a new set. These stages are repeated periodically. In cases where the unwinding section comprises only one unwinder, the stages are repeated until the fiber web on the parent roll runs out from the reeling shaft, at which point the parent roll is replaced, the end of the fiber web from the emptying parent roll is joined to the beginning end of the fiber web from a new parent roll, emptying and the operation restarts with the unwinding of a new parent roll from the reeling shaft. In unwinders of slitter-winders for thick fiber webs the parent roll change in the unwinder is typically slow due to challenges caused by the thick fiber web. Typically it takes even ten minutes.

The joining of the end of the parent roll to the beginning end of the next parent roll creates a joint to the fiber web to be further processed in the slitter-winder to the customer rolls. In connection with thick fiber webs it has been difficult to find a functional joining method. For example, using adhesive tapes has proven disadvantageous, as the tapes may peel off fibers from the surface of the thick fiber webs. At the present the most promising joining method has turned out to be a form fitting joint. But these joints are thicker than the rest of the fiber web and thus, these joints are not welcome in the customer rolls as they may cause problems in the end processing of the thick fiber web obtained from the customer rolls to end products at customer sites. It is known from the prior art to run the slitting and winding process such that the joint is located in the bottom layers of the customer roll, but this has caused vibration problems in further processing of the customer rolls. It is also known from the prior art to run the slitting and winding process such that the joint is located on the outer layer of the customer roll, but this has proven difficult as the process is fast and there is not time to manually remove the joint.

The slitting and winding process is a cyclic process, wherein the process is in the beginning accelerated to a set running speed and when a set of customer rolls is about to be finished the process is decelerated to be stopped for the set change. The finished set of the customer rolls is removed from the winder of the slitter-winder and new cores for winding the next set of the customer rolls are fed to the winder. Thus, the capacity of a slitter-winder is dependent on the sequence times of the slitter-winder, especially on the stopping time, and on the running speed of the slitter-winder.

Slitter-winders employ winding devices of different types, for example multi-station winders and two-drum winders. In the two-drum winders the partial webs are wound around winding cores supported by two winding drums to partial web rolls via a nip between the winding drums and the partial pulp web rolls being formed. In the two-drum winders also a belt arrangement i.e., a so-called set of belt rolls with a belt loop or belt loops located around two guide rolls can be used as the winding drum. As known in the prior art, winding with a shaft without cores or together with cores can also be employed in the winding of a pulp web into customer rolls on a slitter-winder.

An object of the invention is to create a slitter-winder for thick fiber webs and a method for slitting and winding a thick fiber web, in which the disadvantages and problems of the prior art are eliminated or at least minimized.

An object of the invention is to create a slitter-winder for thick fiber webs and a method for slitting and winding a thick fiber web, in which the problems relating to the long parent roll changes are eliminated or at least minimized.

An object of the invention is to create a slitter-winder for thick fiber webs and a method for slitting and winding a thick fiber web, in which the problems relating to the joints are eliminated or at least minimized.

SUMMARY OF THE INVENTION

In this description and in the claims by the term "thick fiber web" is meant a fiber web that has a basis weight of at least 200 g/m$^2$. The present invention relates to production of thick fiber webs and it is especially suitable in connection with the production of pulp webs, as well as thick board webs, such as folding boxboards and liquid packaging boards. The winding drum can also be a belt arrangement i.e., a so-called set of belt rolls with a belt loop or belt loops located around two guide rolls.

According to the invention the slitter-winder for fiber webs comprises an unwinding section, a slitting section and a winding section, and the slitter-winder is configured to unwind, slit and wind a thick fiber web to customer rolls, the thick fiber web having a basic weight of at least 200 g/m$^2$, the unwinding section of the slitter-winder comprises a first unwinder and a second unwinder for unwinding the thick fiber web from a parent roll comprising full-width thick fiber web, and a joining device for joining a beginning end of a thick fiber web coming from a parent roll in the first unwinder to an end of a thick fiber web coming from a parent roll in the second unwinder by forming a joint, and the winding section of the slitter-winder comprises a cutting device for cutting and removing part(s) of the thick fiber web comprising the joint from the winding section.

According to an advantageous feature of the invention in the slitter-winder the slitting section of the slitter-winder comprises slitting blades for slitting the full-width thick fiber web in the longitudinal direction of the thick fiber web to partial thick fiber webs, the winding section of the slitter-winder comprises at least one winding drum for winding the partial thick fiber webs to customer rolls, and the winding section of the slitter-winder has a cutting device for cutting the partial thick fiber webs when a set of the customer rolls is finished and the cutting device is also configured to cut the partial thick fiber webs when a set of the customer rolls is finished.

According to an advantageous feature of the invention the slitting section of the slitter-winder comprises slitting blades for slitting the full-width thick fiber web in the longitudinal direction of the thick fiber web to partial thick fiber webs, the winding section of the slitter-winder comprises at least one winding drum for winding the partial thick fiber webs to customer rolls and the slitting section comprises an additional cutting device configured to cut the partial thick fiber webs when a set of the customer rolls is finished.

According to an advantageous feature of the invention, the slitter-winder comprises a reject handling system configured to receive the cut part(s) comprising the joint removed from the thick fiber webs.

According to an advantageous feature of the invention, the winding section comprises a two drum winder comprising a front winding drum and a back winding drum and that the cutting device is located between the front winding drum and the back winding drum.

According to an advantageous feature of the invention the winding section comprises a two drum winder comprising a front winding drum and a back winding drum and that the cutting device is located below the front winding drum and the back winding drum.

According to an advantageous feature of the invention the winding section comprises a two drum winder comprising a front winding drum and a back winding drum and that the cutting device is located in front of the front winding drum.

According to an advantageous feature of the invention the joining device is configured to form a form-fitting joint.

According to the invention in the method of slitting and winding a fiber web in a slitter-winder comprising an unwinding section, a slitting section and a winding section, a full-width thick fiber web is unwound in the unwinding section, the thick fiber web has basic weight of at least 200 g/m$^2$, in the method the full-width thick fiber web is alternatingly unwound in the unwinding section from a parent roll in a first unwinder and from a parent roll in a second unwinder, in the method a beginning end of a thick fiber web coming from the parent roll in the first unwinder to an end of a thick fiber web coming from the parent roll in the second unwinder by a joining device forming a joint between the beginning end and the end, and in the method part(s) comprising the joint are cut by the cutting device and removed from the winding section automatically.

According to an advantageous feature of the invention in the method the fiber web is slit in the longitudinal direction of the thick fiber web to partial thick fiber webs and the partial thick fiber webs are wound to customer rolls in the winding section, which comprises at least one winding drum and in the method the partial thick fiber webs are cut by the cutting device or by an additional cutting device, when a set of the customer rolls is finished.

According to an advantageous feature of the invention in the method the part(s) of the thick fiber web with the joint is/are guided through the winding section towards a reject handling system.

According to an advantageous feature of the invention the part(s) comprising the joint is/are cut by the cutting device and removed from the thick fiber web of the partial thick fiber webs to the reject handling system through a reject opening or by a reject conveyor.

According to an advantageous feature of the invention, in the method the part(s) of the thick fiber web of the partial thick fiber webs with the joint is/are guided through the winding section over the at least one winding drum.

According to an advantageous feature of the invention the method comprises stages of a) finishing winding of a finished customer roll set and removing the finished customer roll set from the winder, b) changing the unwinding from emptying the parent roll in one unwinder to a new parent roll in the other unwinder and joining the fiber web ends, c) preparing the winder for the next customer roll set winding, and d) beginning steps for the winding of the new customer rolls step.

According to an advantageous feature of the invention in the method stages a) finishing winding of a finished customer roll set and removing the finished customer roll set from the winder and b) changing the unwinding from the emptying parent roll in one unwinder to a new parent roll in the other unwinder and joining the fiber web ends are performed simultaneously.

According to an advantageous feature of the invention in the method before stage a) finishing winding of a finished customer roll set and removing the finished customer roll set from the winder the slitter-winder is decelerated to crawling speed or to a stop.

According to an advantageous feature of the invention in the method after the stage d) beginning steps for the winding of the new customer rolls step the slitter-winder is accelerated to a running speed.

According to an advantageous feature of the invention in the method, the fiber web is jogged, i.e., run at a lower (crawling) speed than the running speed, forward between the cutting for finishing the customer rolls and the cutting of the part(s) of the thick fiber web comprising the joint for removing the part(s) of the thick fiber web comprising the joint.

According to an advantageous aspect of the invention in the slitter-winder for thick fiber webs and in the method of slitting and winding a thick fiber web, in the unwinding section has two unwinders in order to make the supply of the thick fiber web for the slitting and the winding last longer and to decrease the capacity loss of the stopping times. When a parent roll unwound on a first unwinder is almost empty, the end of the fiber web coming from the parent roll on the first unwinder is joined to the beginning end of the fiber web coming from a parent roll on a second unwinder by a joining device based on a form-fitting joint creating technique. The unwinding is changed to the second unwinder and a new parent roll is moved to the first unwinder. When the parent roll unwound on the second unwinder is almost empty, the end of the fiber web coming from the parent roll on the second unwinder is joined to the beginning end of the fiber web coming from the new parent roll on the first unwinder. These stages are repeated until the required customer rolls have been produced.

According to an advantageous aspect of the invention in the method the joining of the fiber web ends in the unwinding section and the set change in the winding section are performed at least partially simultaneously.

According to an advantageous aspect of the invention the joint is removed from the thick fiber web in the winding section of the slitter-winder before the beginning ends of the slitted partial fiber webs are guided to be wound to the customer rolls. Thus, the joints are not present in the finished customer rolls.

According to an advantageous aspect of the invention in the method the joint is guided via the winding section towards a pulper or other reject handling of the fiber web production line and thereafter the thick fiber web is cut such that the part of the thick fiber web with the joint is guided to the pulper or the reject handling and the new end of the thick fiber is guided to winding of the customer rolls.

According to an advantageous aspect of the invention as the cutting device cutting the part of the thick fiber web with the joint is utilized the cutting device of the slitter-winder is used for cutting the partial fiber webs. Advantageously, a blowing device may be utilized for helping guidance of the part of the thick fiber web with the joint.

According to an advantageous aspect of the invention in the method the set change is interrupted after the customer rolls have been removed from the winder before the cores for the next customer roll set winding are placed in the slitter-winder. Advantageously, the cores for the next customer roll set winding are placed in the slitter-winder after the part of the thick fiber web with the joint has been removed.

By the invention and its advantageous features many advantages are achieved: The change time of the parent roll in the unwinding section is reduced to less than two minutes, which improves the capacity of the slitter-winder for thick fiber webs significantly, even 30-40%. This also provides the possibility of using higher running speed at a board machine or at a pulp dryer. Additionally, the customer rolls are provided to the customers without joints, which improves the production of the end products at the customer site. One of the main advantages is also that no manual removal of joints is needed. Further, stability of winding of the customer rolls in the winding section is improved in cases where form-fitting joints are used, as the joints do not function as an impulse for possible vibration.

BRIEF DESCRIPTION OF THE DRAWINGS

In the following the invention is explained in detail with reference to the accompanying drawings to which the invention is not to be narrowly limited.

During the course of the following description, like numbers and signs will be used to identify like elements according to the different views which illustrate the invention and its advantageous examples. In the figures some repetitive reference signs have been omitted for clarity.

DESCRIPTION OF THE PREFERRED EMBODIMENTS

Figure 1A:
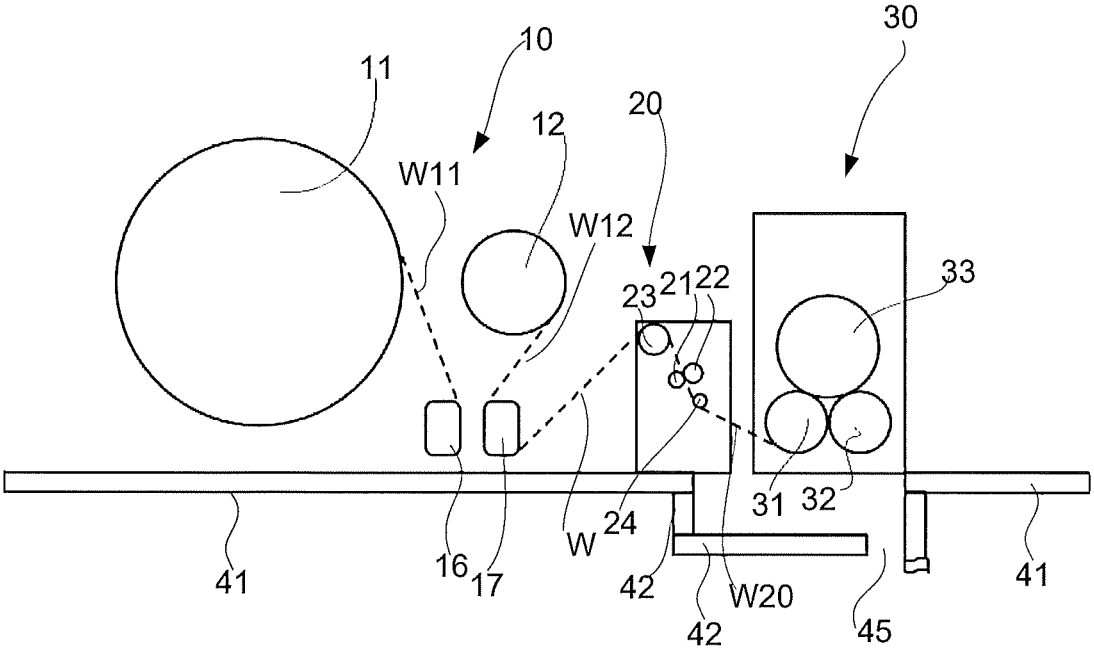
In FIGS. 1A-1E is shown schematically an advantageous example of a slitter-winder and a method for slitting and winding a thick fiber web. In this example the part(s) with the joint J is/are removed before starting of winding of the next set of the customer rolls by a cutting device 35 located between the two winding drums 31, 32 and after the finished customer rolls 33 have been pushed off from the winder.

In the examples of the figures is schematically shown a slitter-winder for fiber webs, which comprises an unwinding section 10, a slitting section 20 and a winding section 30. The slitter-winder is configured to unwind, slit and wind a thick fiber web having a basic weight of at least 200 g/m$^2$ to customer rolls 33. The unwinding section 10 of the slitter-winder comprises two unwinders: a first unwinder 11 and a second unwinder 12 for unwinding the thick fiber web from a parent roll comprising a full-width thick fiber web W11, W12. The unwinding section 10 further comprises a joining device 16, 17 for joining a beginning end of a thick fiber web W11 coming from a parent roll in the first unwinder to an end of a thick fiber web W12 coming from a parent roll in the second unwinder by forming a joint J. The winding section 30 of the slitter-winder has a cutting device 35 for cutting and removing part(s) of the thick fiber web comprising the joint J from the winding section 20.

The slitting section 20 of the slitter-winder comprises slitting blades 21, 22 for slitting the full-width thick fiber web W11; W12 in the longitudinal direction of the thick fiber web to partial thick fiber webs W20. The winding section 30 of the slitter-winder comprises at least one winding drum 31; 32 for winding the partial thick fiber webs W20 to customer rolls 33 and the cutting device 35 is also configured to cut the partial thick fiber webs when a set of the customer rolls 33 is finished or the slitting section 20 comprises an additional cutting device configured to cut the partial thick fiber webs when a set of the customer rolls 33 is finished. The cutting device 35 is a full width cutting blade or a traversing fixed or rotating blade. The cutting device 35 may also be a scoring device for weakening the thick fiber web at the cutting location and the actual cutting is provided by tension, blowing or as such by one skilled in the art known manner.

The slitter-winder comprises a reject handling system configured to receive the cut part(s) comprising the joint J removed from the thick fiber web or from the partial thick fiber webs W. The joining device 16,17 is advantageously configured to form a form-fitting joint J. In the method of slitting and winding a fiber web in a slitter-winder according to the examples of the figures a full-width thick fiber web W11, W12 is unwound is the unwinding section 10, and the full-width thick fiber web W11, W12 is alternatingly unwound in the unwinding section 10 from a parent roll in a first unwinder 11 and from a parent roll in a second unwinder 12. In the method a beginning end of a thick fiber web W11 coming from the parent roll in the first unwinder to an end of a thick fiber web W12 coming from the parent roll in the second unwinder by a joining device 16, 17 forming a joint J between the beginning end and the end. In the method part(s) of the thick fiber web comprising the joint J are cut by the cutting device 35 and removed from the winding section 30 automatically. In the method the part(s) of the thick fiber web comprising the joint J is/are guided through the winding section 30 towards a reject handling system over the at least one winding drum 31; 32, as the part(s) comprising the joint J is/are cut by the cutting device 35 and removed from the thick fiber web or the partial thick fiber webs W to the reject handling system through the reject opening 45 or by the reject conveyor. Thus, the method comprises the stages of a) finishing winding of a finished customer roll set and removing the finished customer roll set from the winder, b) changing the unwinding from emptying parent roll in one unwinder to a new parent roll in the other unwinder and joining the fiber web ends, c) preparing the winder for the next customer roll set winding, and d) beginning steps for the winding of the new customer rolls. In the method stages a) finishing winding of a finished customer roll set and removing the finished customer roll set from the winder and b) changing the unwinding from the emptying parent roll in one unwinder to a new parent roll in the other unwinder and joining the fiber web ends are performed simultaneously. In the method before stage a) finishing winding of a finished customer roll set and removing the finished customer roll set from the winder the slitter-winder is decelerated to crawling speed or to a stop. In the method after the stage d) beginning steps for the winding of the new customer rolls step the slitter-winder is accelerated to a running speed.

Figure 1B:
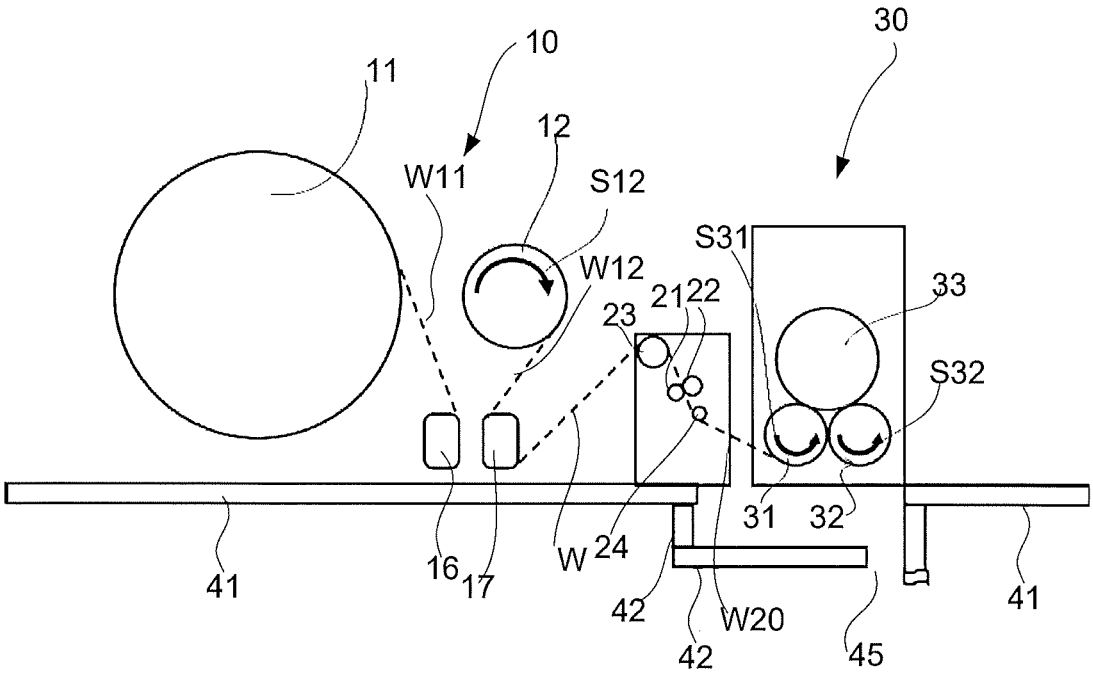
Figure 1C:
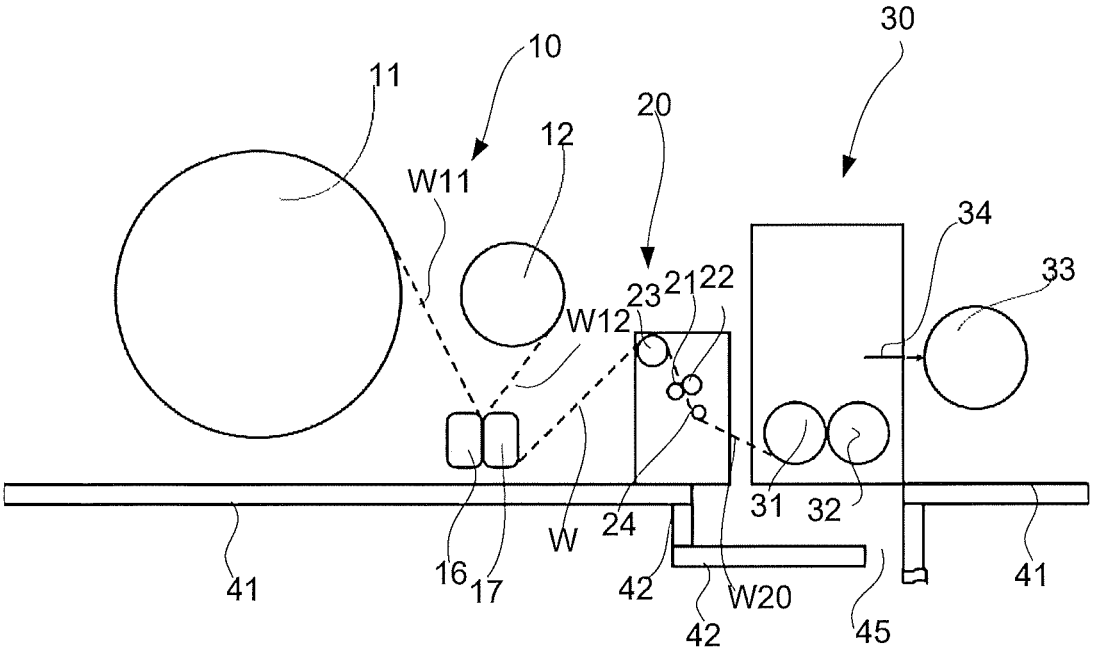

In FIGS. 1A-1E is shown an example of a slitter-winder and a method for slitting and winding a thick fiber web. The slitter-winder comprises an unwinding section 10, a slitting section 20 and a winding section 30. The unwinding section 10 comprises two unwinders 11, 12, a first unwinder 11 and a second unwinder 12, for alternating unwinding a parent roll of full-width thick fiber web W11 coming from the first unwinder and a parent roll of full-width thick fiber web W12 coming from the second unwinder 12. The slitter-winder also comprises a joining device 16, 17 for joining the end of the thick fiber web coming from the emptying parent roll in the second unwinder 12 to the beginning end of the thick fiber web coming from the parent roll to be unwound in the first unwinder 11. By the joining device 16, 17 a joint is formed to attach the beginning end of a second thick fiber web unwinding from one parent roll to the end of the thick fiber web coming from another parent roll. The joint is advantageously a form-fitting joint. The slitting section 20 comprises a guide roll 23 to guide the thick fiber web W between the slitting blades 21,22, which slit the thick fiber wet W in the longitudinal direction to partial thick fiber webs W20, which have desired widths. The partial thick fiber webs W20 are guided via a guide roll 24 to the winding section 30. The winding section 30 comprises a two drum winder comprising two winding drums 31, 32, a back winding drum 31 and a front winding drum 32, on top of which the customer rolls 33 of the partial thick fiber webs W20 are wound. The part(s) with the joint J can be guided through the slitting section while the slitting blades 21, 22 are in a non-cutting position or in a cutting position. The winding section 30 also comprises a cutting device 35, which is located between the winding drums 31, 32, for cutting part(s) with the joint J of the thick fiber web W20 or the partial thick fiber webs W. The cutting device 35 can also be used for cutting the partial thick fiber webs during a set-change or the winding section can comprise an additional cutting device for cutting the partial thick fiber webs during the set-change. As shown in FIG. 1C, the winding section 30 also comprises a pusher 34 for removing the finished customer roll set 33 from the winder. A reject opening 45 or a reject conveyor to a reject handling system, for example to a pulper, is located in the winding section 30. Through the reject opening 45 or via a reject conveyor the part(s) WR of the thick fiber web having the joint J is guided to the reject handing system before in the winding section 30 winding of a next customer roll set is begun. The winding section 30 may also comprise a blowing means for assisting the guiding of the part(s) with the joint J towards the reject opening 45 or onto the reject conveyor. The slitter-winder is located on the floor level 41, which may comprise an offset floor level part 42, which in this example is located partially under the slitting section 20 and under the winding section.

In FIG. 1A the method for slitting and winding a thick fiber web in the slitter-winder is in a stage, in which the thick fiber web W12 is still running therefrom through the slitting section 20 from the parent roll in the second unwinder 12 is running via the slitting section 20 and after slitting the partial thick fiber webs W20 are running to the unwinding section 30 and the customer roll set 33 in the winder of the winding section is under winding. The thick fiber web W12 runs via the front part 17 of the joining device 16, 17.

In FIG. 1B the method for slitting and winding a thick fiber web in the slitter-winder is in a stage in which the parent roll in the second unwinder 12 in the unwinding section 10 is almost empty but the thick fiber web W12 is still running therefrom through the slitting section 20 to the unwinding section 30 and the customer roll set 33 in the winder of the winding section is almost finished. The thick fiber web W12 runs via the front part 17 of the joining device 16, 17 and the thick fiber web W11 is attached to the back part 16 of the joining device 16, 17, and thus, the joining device 16, 17 is in position of readiness. The rotation direction of the second unwinder 12 is denoted by an arrow S12 and the rotation directions of the winding drums 31, 32 are denoted by arrows S31, 32.

In FIG. 1C the method for slitting and winding a thick fiber web in the slitter-winder is in a stage, in which the slitter-winder is slowed down to a crawling speed or to a stop. At this stage the joint is formed to attach the beginning end of a second thick fiber web unwinding from the new parent roll coming from the first unwinder 11 to the end of the thick fiber web coming from the emptying parent roll in the second unwinder 12 by the joining device 16, 17. The advantageous form-fitting joint can be formed by pressing the beginning end and the end between the front part 17 and the back part 16 of the joining device 16, 17 together. One of the parts 16; 17 may have cutting elements for forming a joining cut and the other part 17 has a counter part to the cutting elements. After the joint has been formed the full-width thick fiber web running from the second unwinder 12 is cut. In the winder the partial thick fiber webs W20 running to form the customer roll set 33 are cut by the cutting device 35 and simultaneously the finished customer roll set 33 is removed from the winder of the winding section 30 by a pusher 34.

Figure 1D:
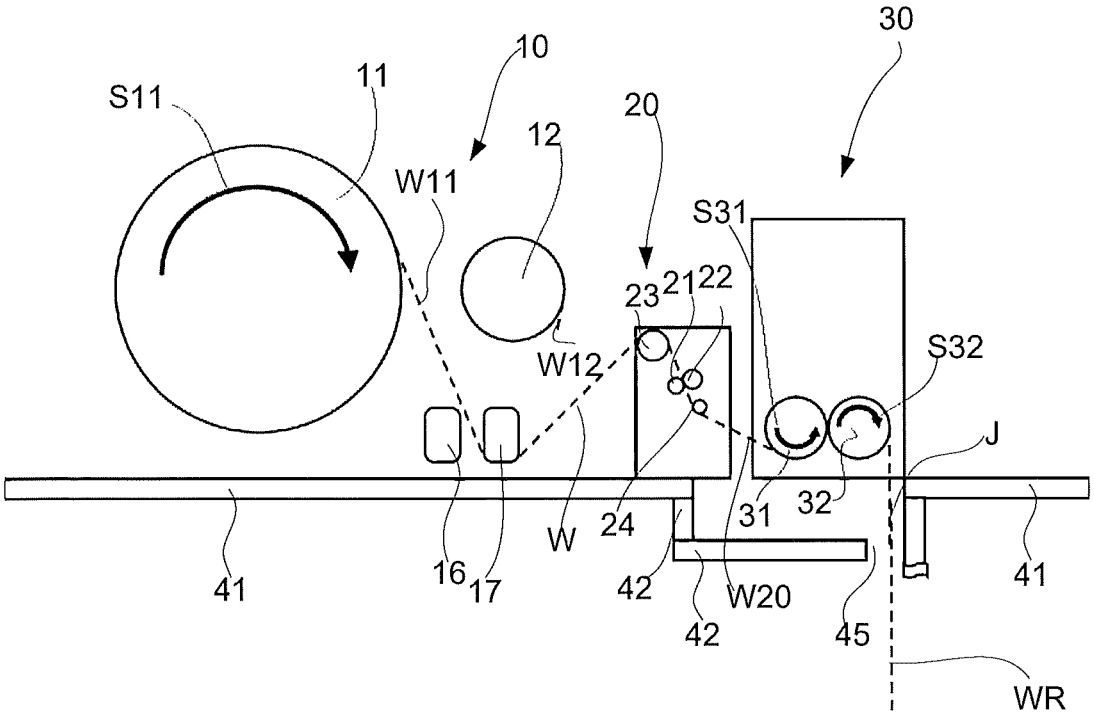

In FIG. 1D the method for slitting and winding a thick fiber web in the slitter-winder is in a stage, in which the slitter-winder is still slowed down to the crawling speed or at the stop. At this stage in the unwinding section 10 the unwinding has been changed to the first unwinder 11 and thus, to the new parent roll and the thick fiber web W11 with the joint J runs through the slitting section 20, in which the slitting blades 21, 22 are advantageously in a non-cutting position but they can also be in a cutting position, to the winding section 30 and through the winding section 30 and is guided as the reject fiber web towards the reject handling system via the reject opening 45 or by a reject conveyor. Thus, the part(s) with the joint J is/are guided via the reject opening 45 or via the reject conveyor to the reject handling system.

Figure 1E:
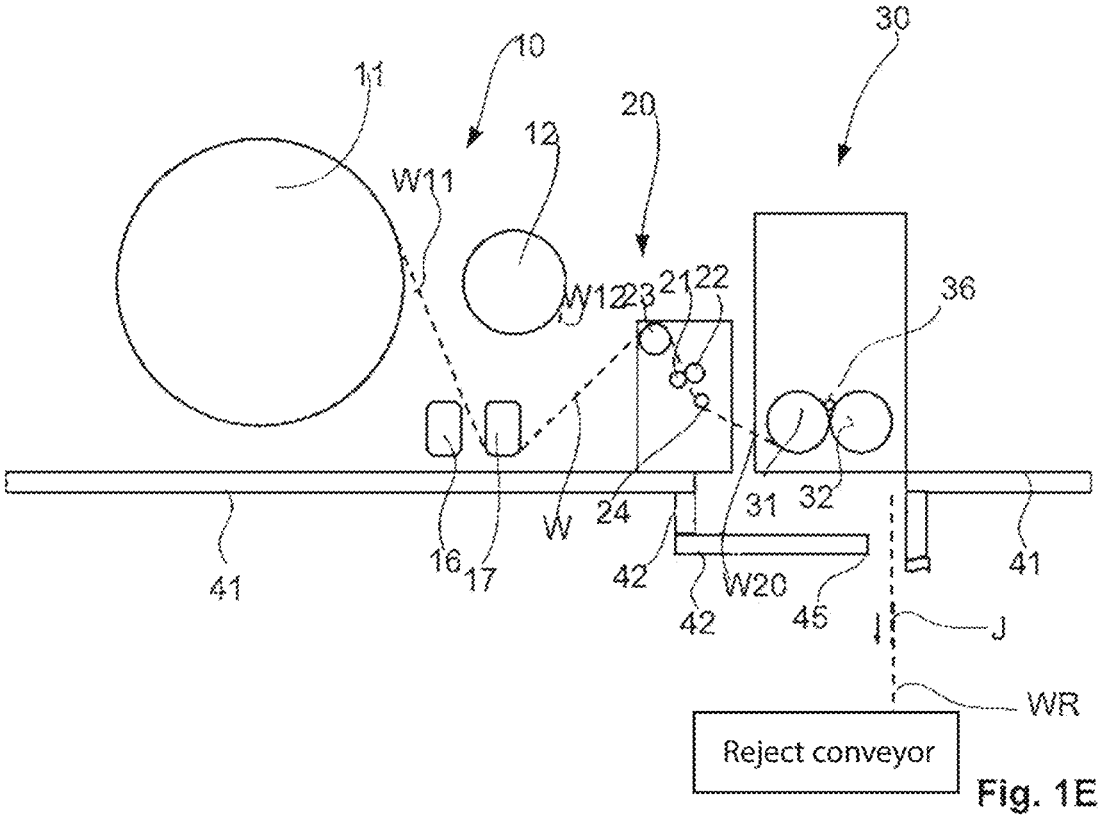

In FIG. 1E the method for slitting and winding a thick fiber web in the slitter-winder is in a stage, in which the slitter-winder is still slowed down to the crawling speed or at the stop. At this stage, the reject fiber web WR is cut by the cutting device 35 and the beginning end of the partial thick fiber webs W20 are guided between the winding drums 31, 32 and winding cores 36 placed on support of the winding drums 31, 32. The slitter-winder is accelerated to the operating, running speed and the slitting and winding of a new customer roll set begins.

Figure 2A:
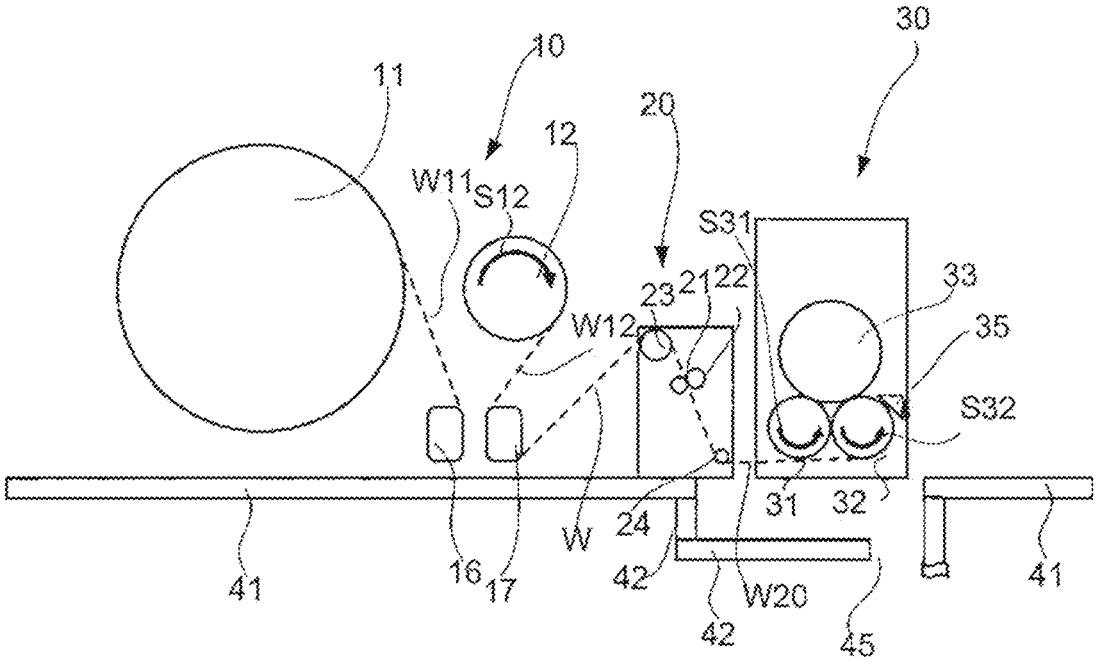
In FIGS. 2A-2E is shown schematically another advantageous example of a slitter-winder and a method for slitting and winding a thick fiber web. In this example the partial thick fiber webs W20 are guided to the winder around the front winding drum 32. The part(s) with the joint J W20 is/are removed, before starting of winding of the next set of the customer rolls, by a cutting device 35 located in front of the front winding drum 32 and after the finished customer rolls 33 have been pushed off from the winder.
Figure 2B:
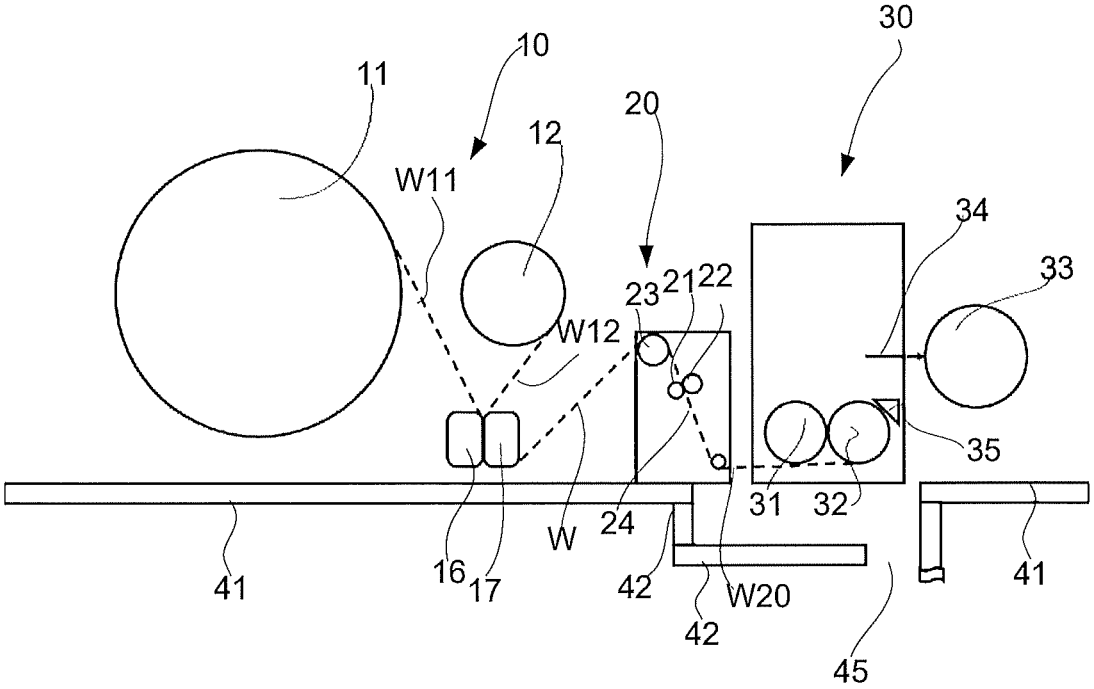

In FIGS. 2A-2E is shown another example of a slitter-winder and a method for slitting and winding a thick fiber web. The slitter-winder comprises an unwinding section 10, a slitting section 20 and a winding section 30. The unwinding section 10 comprises two unwinders 11, 12, a first unwinder 11 and a second unwinder 12, for alternating unwinding a parent roll of full-width thick fiber web W11 coming from the first unwinder and a parent roll of full-width thick fiber web W12 coming from the second unwinder 12. The slitter-winder also comprises a joining device 16, 17 for joining the end of the thick fiber web coming from the emptying parent roll in the second unwinder 12 to the beginning end of the thick fiber web coming from the parent roll to be unwound in the first unwinder 11. By the joining device 16, 17 a joint is formed to attach the beginning end of a second thick fiber web unwinding from one parent roll to the end of the thick fiber web coming from another parent roll. The joint is advantageously a form-fitting joint, for example as described in applicants' EP patent application. The slitting section 20 comprises first a guide roll 23 to guide the thick fiber web W between the slitting blades 21,22 which slit the thick fiber web W in the longitudinal direction to partial thick fiber webs W20, which have desired widths. The partial thick fiber webs W20 are guided via a guide roll 24 to the winding section 30. The winding section 30 comprises a two drum winder comprising two winding drums 31, 32, a back winding drum 31 and a front winding drum 32, on top of which the customer rolls 33 of the partial thick fiber webs W20 are wound. The part(s) with the joint J can be guided through the slitting section while the slitting blades 21, 22 are in a non-cutting position or in a cutting position. The winding section 30 also comprises a cutting device 35 which is located in front of the front winding drum 32, for cutting the part with the joint J from the thick fiber web W20. The cutting device 35 can also be used for cutting the partial thick fiber webs during a set-change or the winding section can comprise an additional cutting device for cutting the partial thick fiber webs during the set-change. As shown in FIG. 2B, the winding section 30 also comprises a pusher 34 for removing the finished customer roll set 33 from the winder. A reject opening 45 or a reject conveyor to a reject handling system, for example to a pulper, is located in the winding section 30. Through the reject opening 45 or by the reject conveyor the part(s) WR of the thick fiber web having the joint J is guided to the reject handing system before in the winding section 30 winding of a next customer roll set is begun. The winding section 30 may also comprise a blowing means for assisting the guiding of the part(s) with the joint J towards the reject opening 45 or onto the reject conveyor. The slitter-winder is located on the floor level 41, which may comprise an offset floor level part 42, which in this example is located partially under the slitting section 20 and under the winding section.

In FIG. 2A the method for slitting and winding a thick fiber web in the slitter-winder is in a stage, in which the thick fiber web W12 is still running therefrom through the slitting section 20 from the parent roll in the second unwinder 12 is running via the slitting section 20 and after slitting the partial thick fiber webs W20 are running to the unwinding section 30 and the customer roll set 33 in the winder of the winding section is under winding. The thick fiber web W12 runs via the front part 17 of the joining device 16, 17. When the parent roll in the second unwinder 12 in the unwinding section 10 is almost empty but the thick fiber web W12 is still running therefrom through the slitting section 20 to the unwinding section 30 and the customer roll set 33 in the winder of the winding section is almost finished. The thick fiber web W12 runs via the front part 17 of the joining device 16, 17 and the thick fiber web W11 is attached to the back part 16 of the joining device 16, 17, and thus, the joining device 16, 17 is in position of readiness. Rotation direction of the second unwinder 12 is denoted by an arrow S12 and rotation directions of the winding drums 31, 32 are denoted by arrows S31, 32.

In FIG. 2B the method for slitting and winding a thick fiber web in the slitter-winder is in a stage, in which the slitter-winder is slowed down to a crawling speed or to a stop. At this stage the joint is formed to attach the beginning end of a second thick fiber web unwinding from the new parent roll coming from the first unwinder 11 to the end of the thick fiber web coming from emptying parent roll in the second unwinder 12 by the joining device 16, 17. The advantageous form-fitting joint can be formed by pressing the beginning end and the end between the front part 17 and the back part 16 of the joining device 16, 17 together. One of the parts 16; 17 may have cutting elements for forming a joining cut and the other part 17 then has counterpart-elements to the cutting elements. After the joint has been formed the full-width thick fiber web running from the second unwinder 12 is cut. In the winder the partial thick fiber webs W20 running to form the customer roll set 33 are cut by the cutting device 35 and simultaneously the finished customer roll set 33 is removed from the winder of the winding section 30 by a pusher 34.

Figure 2C:
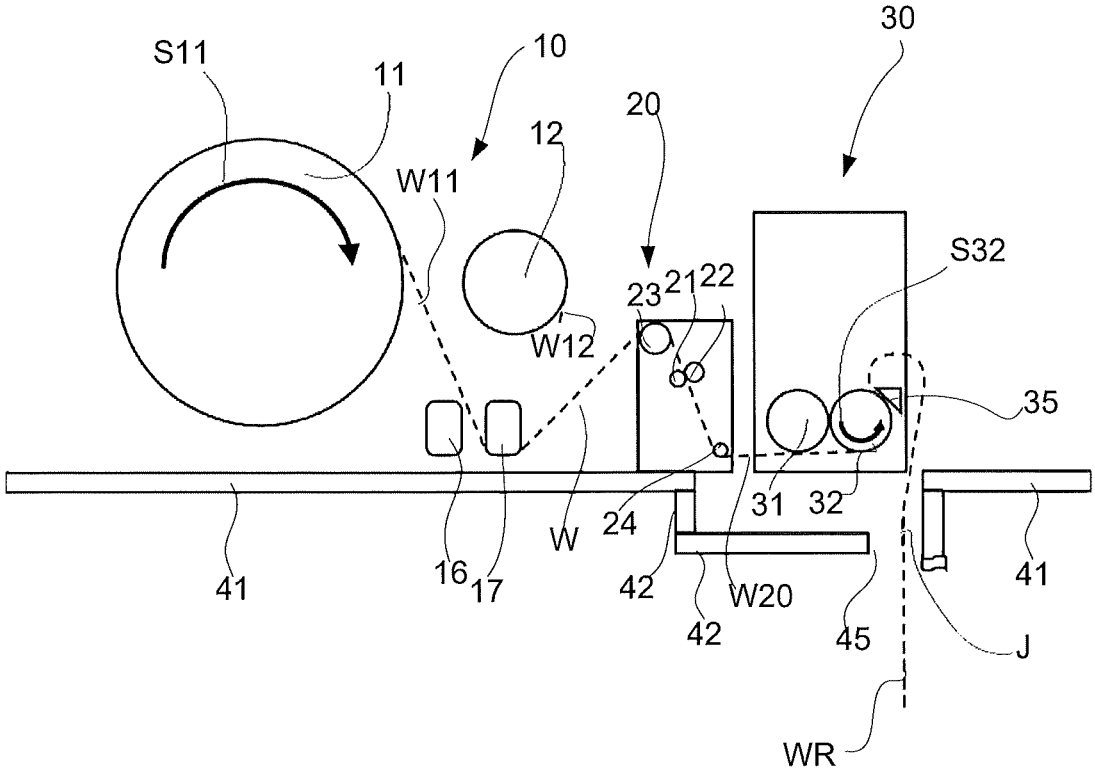

In FIG. 2C the method for slitting and winding a thick fiber web in the slitter-winder is in a stage, in which the slitter-winder is still slowed down to the crawling speed or at the stop. At this stage in the unwinding section 10 the unwinding has been changed to the first unwinder 11 and thus, to the new parent roll and the thick fiber web W11 with the joint J runs through the slitting section 20, in which the slitting blades 21, 22 are advantageously in a non-cutting position but they can also be in a cutting position, to the winding section 30 and is guided as the reject fiber web towards the reject handling system via the reject opening 45 or by a reject conveyor. Thus, the part(s) with the joint J is/are guided via the reject opening 45 or by the reject conveyor to the reject handling system.

Figure 2D:
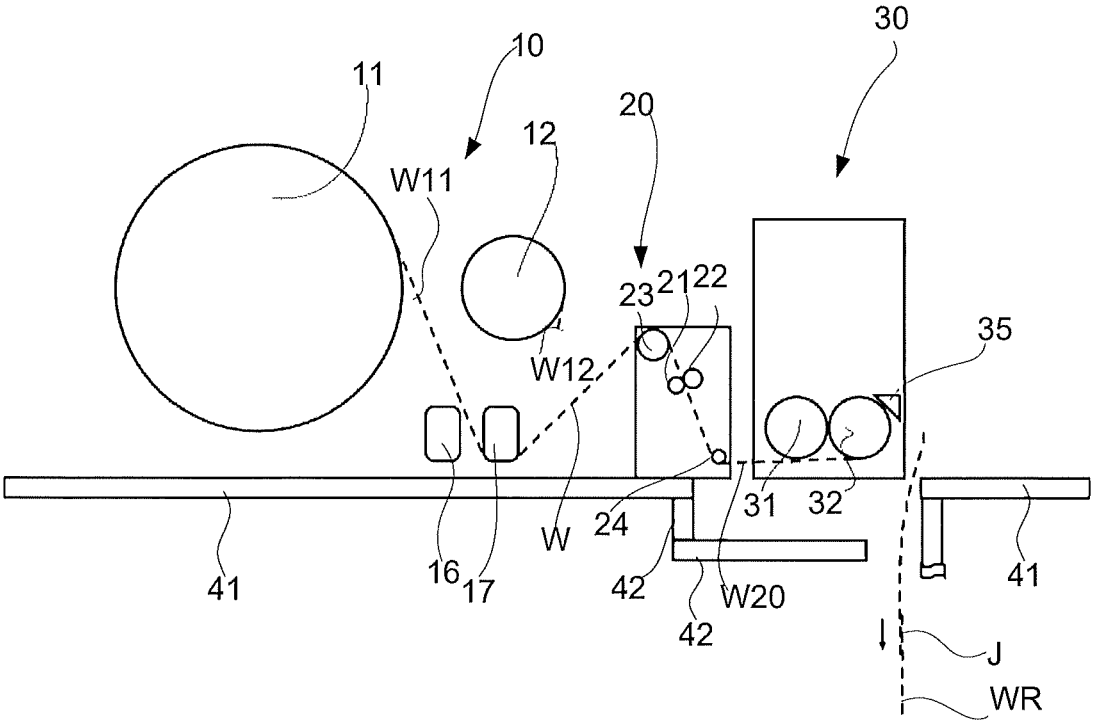

In FIG. 2D the method for slitting and winding a thick fiber web in the slitter-winder is in a stage, in which the slitter-winder is still slowed down to the crawling speed or at the stop. At this stage, the reject fiber web WR is cut by the cutting device 35 and the part with the joint is thus guided to the reject handling.

Figure 2E:
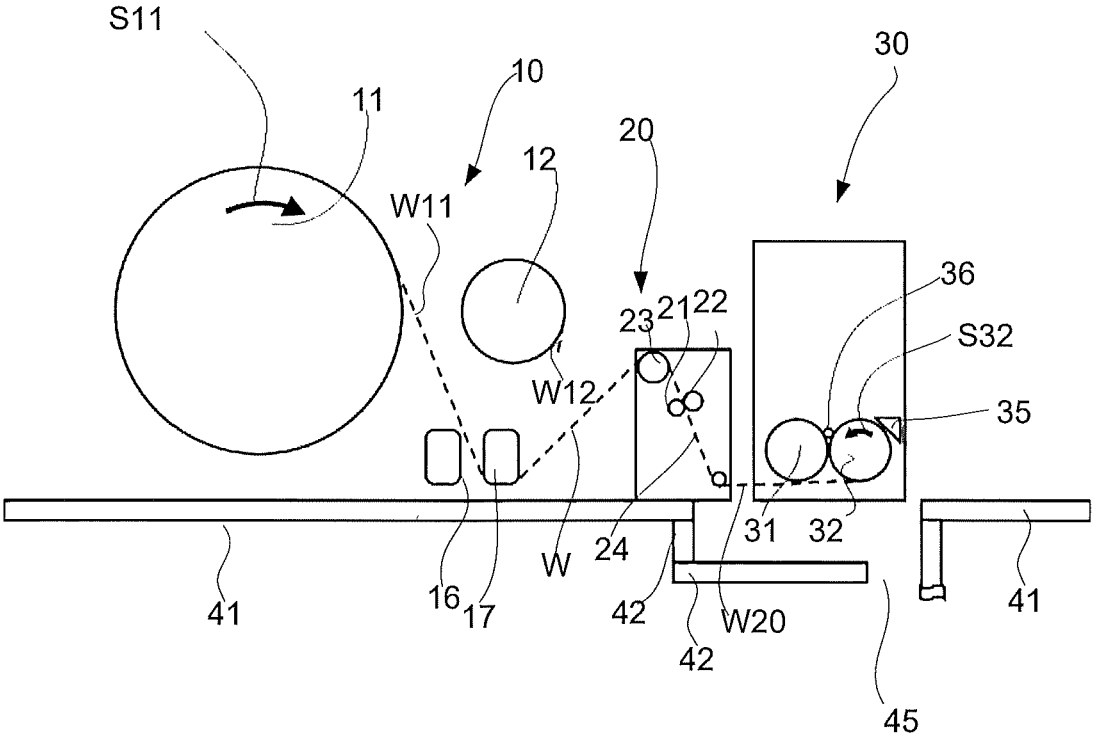

In FIG. 2E the method for slitting and winding a thick fiber web in the slitter-winder is in a stage, in which the beginning end of the partial thick fiber webs W20 are guided between the winding drums 31, 32 and winding cores 36 placed on support of the winding drums 31, 32, while the front winding drum 32 is rotating, as shown by an arrow S31. The slitter-winder is accelerated to the operating, running speed and the slitting and winding of a new customer roll set begins.

In FIGS. 3A-3D is shown yet another example of a slitter-winder and a method for slitting and winding a thick fiber web. The slitter-winder comprises an unwinding section 10, a slitting section 20 and a winding section 30. The unwinding section 10 comprises two unwinders 11, 12, a first unwinder 11 and a second unwinder 12, for alternating unwinding a parent roll of full-width thick fiber web W11 coming from the first unwinder and a parent roll of full-width thick fiber web W12 coming from the second unwinder 12. The slitter-winder also comprises a joining device 16, 17 for joining the end of the thick fiber web coming from the emptying parent roll in the second unwinder 12 to the beginning end of the thick fiber web coming from the parent roll to be unwound in the first unwinder 11. By the joining device 16, 17 a joint is formed to attach the beginning end of a second thick fiber web unwinding from one parent roll to the end of the thick fiber web coming from another parent roll. The joint is advantageously a form-fitting joint, for example as described in applicants' EP patent application. The slitting section 20 comprises first a guide roll 23 to guide the thick fiber web W between the slitting blades 21,22, which slit the thick fiber web W in the longitudinal direction to partial thick fiber webs W20, which have desired widths. The partial thick fiber webs W20 are guided via a guide roll 24 to the winding section 30. The winding section 30 comprises a two drum winder comprising two winding drums 31, 32, a back winding drum 31 and a front winding drum 32, on top of which the customer rolls 33 of the partial thick fiber webs W20 are wound. The part(s) with the joint J can be guided through the slitting section while the slitting blades 21, 22 are in a non-cutting position or in a cutting position. The winding section 30 also comprises a cutting device 35 which is located below the winding drums 32, for cutting the joint end of the thick fiber web W20 The cutting device 35 can also be used for cutting the partial thick fiber webs during a set-change or the winding section can comprise an additional cutting device for cutting the partial thick fiber webs during the set-change. The winding section 30 also comprises a pusher 34 for removing the finished customer roll set 33 from the winder. A reject opening 45 or a reject conveyor to a reject handling system, for example to a pulper, is located in the winding section 30. Through the reject opening 45 or via the reject conveyor the part(s) WR of the thick fiber web having the joint J is guided to the reject handing system before in the winding section 30 winding of a next customer roll set is begun. The winding section 30 may also comprise a blowing means for assisting the guiding of the part(s) with the joint J towards the reject opening 45 or the reject conveyor. The slitter-winder is located on the floor level 41, which may comprise an offset floor level part 42, which in this example is located partially under the slitting section 20 and under the winding section.

Figure 3A:
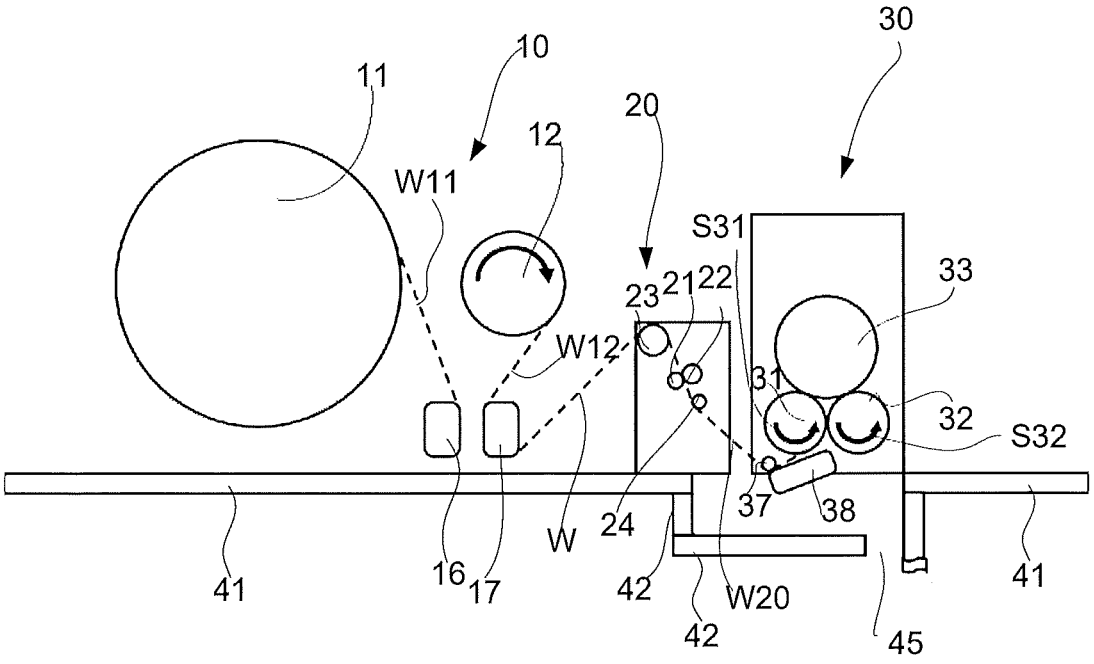
In FIGS. 3A-3D is shown schematically yet another advantageous example of a slitter-winder and a method for slitting and winding a thick fiber web. In this example the partial thick fiber webs W20 are guided to the winder between the two winding drums 31, 32 or around the front winding drum 32. The part(s) with the joint J is/are removed, before starting of winding of the next set of the customer rolls, by a cutting device 35 located below the winding drums 31, 32 and after the finished customer rolls 33 have been pushed off from the winder.

In FIG. 3A the method for slitting and winding a thick fiber web in the slitter-winder is in a stage, in which the thick fiber web W12 is still running therefrom through the slitting section 20 from the parent roll in the second unwinder 12 is running via the slitting section 20 and after slitting the partial thick fiber webs W20 are running to the unwinding section 30 and the customer roll set 33 in the winder of the winding section is under winding. The thick fiber web W12 runs via the front part 17 of the joining device 16, 17. When the parent roll in the second unwinder 12 in the unwinding section 10 is almost empty but the thick fiber web W12 is still running therefrom through the slitting section 20 to the unwinding section 30 and the customer roll set 33 in the winder of the winding section is almost finished. The thick fiber web W12 runs via the front part 17 of the joining device 16, 17 and the thick fiber web W11 is attached to the back part 16 of the joining device 16, 17, and thus, the joining device 16, 17 is in a position of readiness. The rotation direction of the second unwinder 12 is denoted by an arrow S12 and rotation directions of the winding drums 31, 32 are denoted by arrows S31, 32.

Figure 3B:
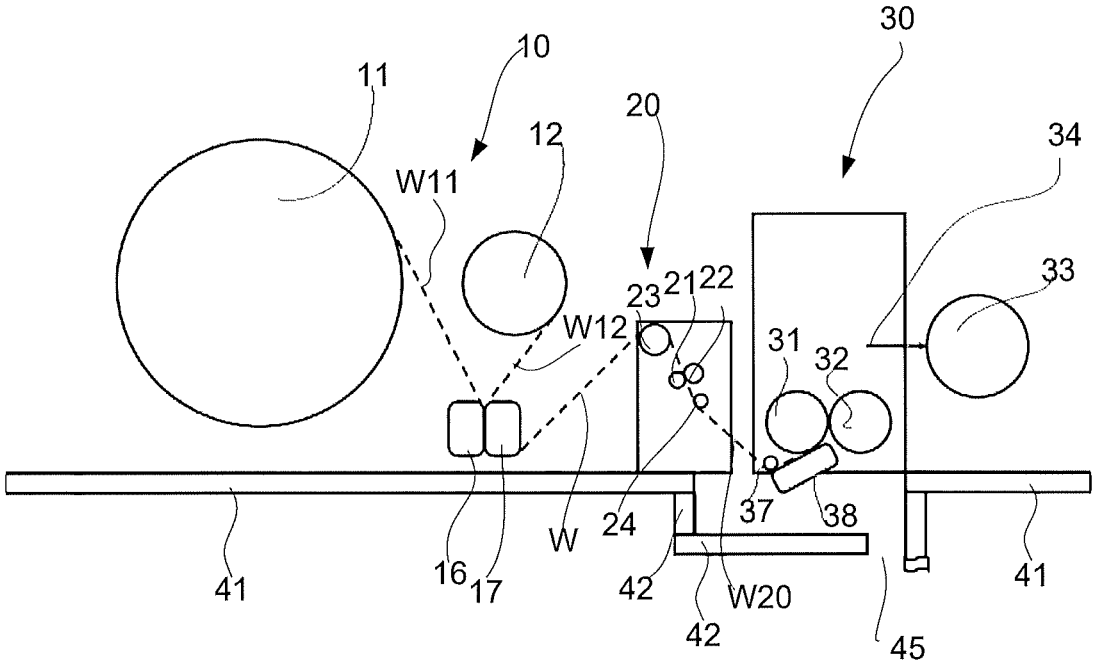

In FIG. 3B the method for slitting and winding a thick fiber web in the slitter-winder is in a stage, in which the slitter-winder is slowed down to a crawling speed or to a stop. At this stage the joint is formed to attach the beginning end of a second thick fiber web unwinding from the new parent roll coming from the first unwinder 11 to the end of the thick fiber web coming from emptying parent roll in the second unwinder 12 by the joining device 16, 17. The advantageous form-fitting joint can be formed by pressing the beginning end and the end between the front part 17 and the back part 16 of the joining device 16, 17 together. One of the parts 16; 17 may have cutting elements for forming a joining cut and the other part 17 has a counter part to the cutting elements. After the joint has been formed the full-width thick fiber web running from the second unwinder 12 is cut. In the winder the partial thick fiber webs W20 running to form the customer roll set 33 are cut by the cutting device 35 and simultaneously the finished customer roll set 33 is removed from the winder of the winding section 30 by a pusher 34.

Figure 3C:
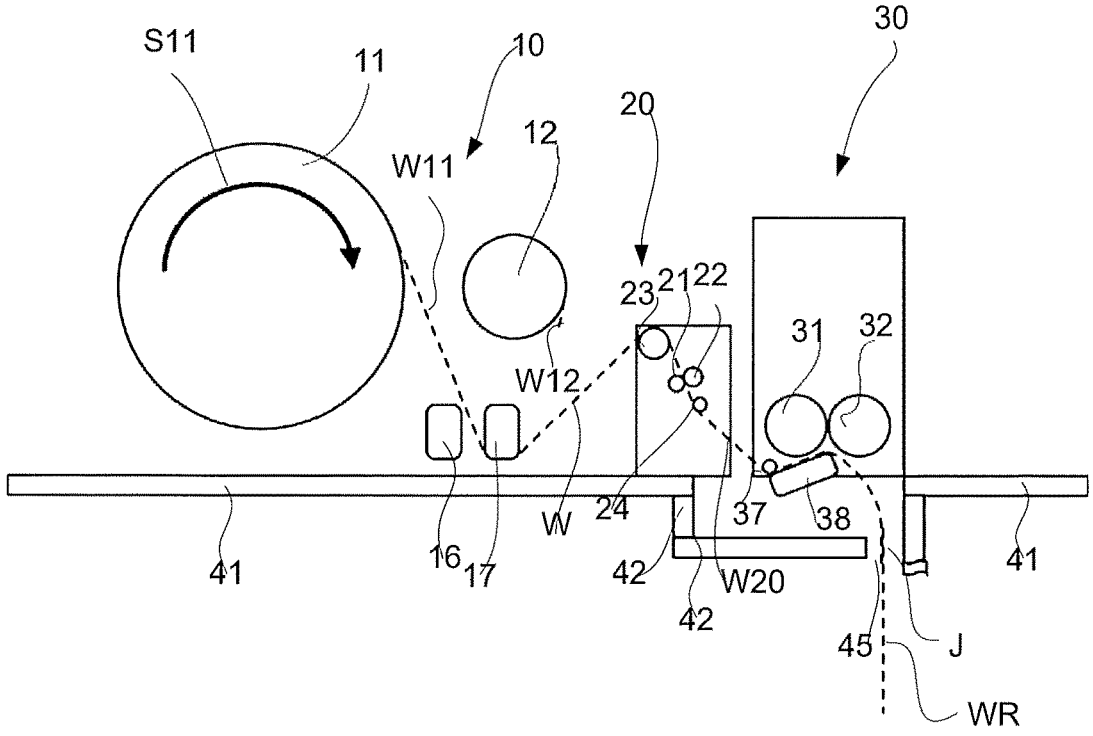

In FIG. 3C the method for slitting and winding a thick fiber web in the slitter-winder is in a stage, in which the slitter-winder is still slowed down to the crawling speed or at the stop. At this stage in the unwinding section 10 the unwinding has been changed to the first unwinder 11 and thus, to the new parent roll and the thick fiber web W11 with the joint J runs through the slitting section 20, in which the slitting blades 21, 22 are advantageously in a non-cutting position but they can also be in a cutting position, to the winding section 30 and through the winding section 30 and is guided as the reject fiber web towards the reject handling system via the reject opening 45 or by a reject conveyor. Thus, the part(s) with the joint J is/are guided via the reject opening 45 or by the reject conveyor to the reject handling system.

Figure 3D:
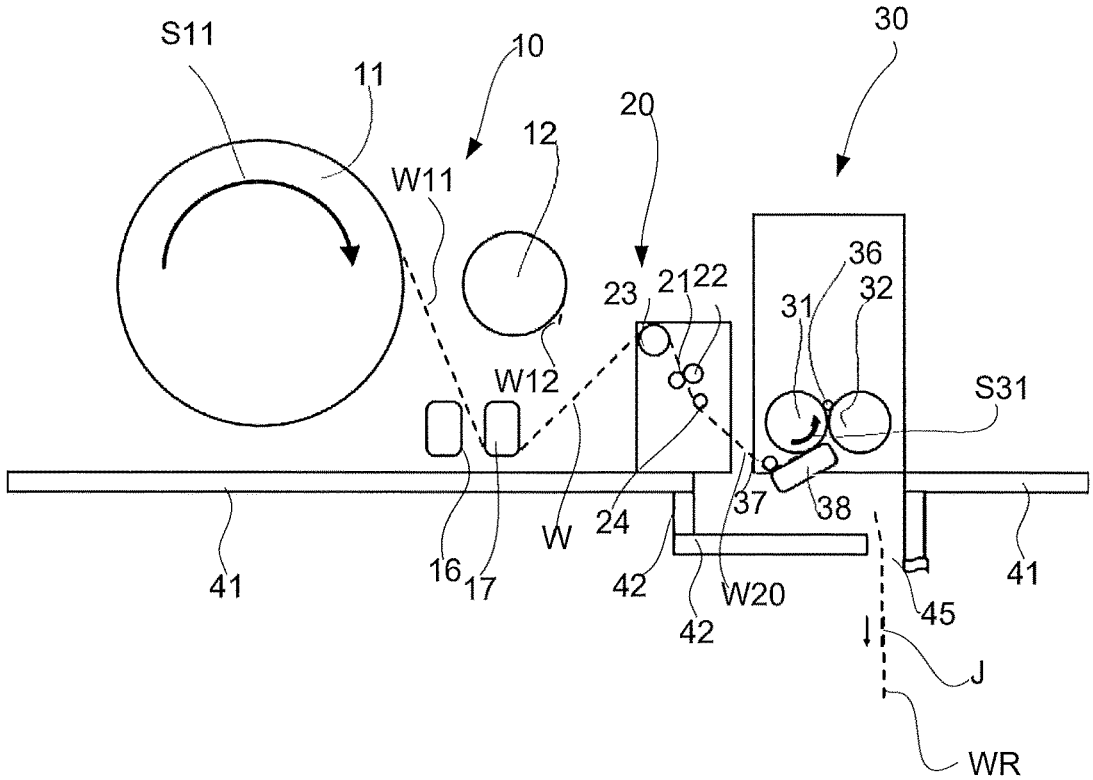

In FIG. 3D the method for slitting and winding a thick fiber web in the slitter-winder is in a stage, in which the slitter-winder is still slowed down to the crawling speed or at the stop. At this stage, the reject fiber web WR is cut by the cutting device 35 and the beginning end of the partial thick fiber webs W20 are guided between the winding drums 31, 32 and winding cores 36 placed on support of the winding drums 31, 32, while the back winding drum 31 is rotated, as shown by an arrow S31. The slitter-winder is accelerated to the operating, running speed and the slitting and winding a new customer roll set begins.

In the method the fiber web is jogged, i.e. run at a lower (crawling) speed than the running speed, forward between the cutting for finishing the customer rolls and the cutting of the part(s) of the thick fiber web comprising the joint for removing the part(s) of the thick fiber web comprising the joint.

In the description in the foregoing, although some functions have been described with reference to certain features and examples, those functions may be performable by other features and examples whether described or not. Although features have been described with reference to the certain examples, those features may also be present in other examples whether described or not.

Above only some advantageous examples of the inventions have been described to which examples the invention is not to be narrowly limited and many modifications and alterations are possible within the invention.

We claim:

1. A slitter-winder for fiber webs, wherein the slitter-winder is configured to unwind, slit and wind a thick fiber web having a basic weight of at least 200 g/m$^2$ to customer rolls, the slitter winder comprising:

an unwinding section having a first unwinder and a second unwinder for unwinding the thick fiber web from a parent roll comprising full-width thick fiber web, and a joining device for joining a beginning end of a thick fiber web coming from a parent roll in the first unwinder to an end of a thick fiber web coming from a parent roll in the second unwinder by forming a joint;

a slitting section after the unwinding section; and a winding section having a cutting device for cutting and removing part(s) of the thick fiber web comprising the joint from the winding section.

2. The slitter-winder of claim 1 wherein the slitting section of the slitter-winder comprises slitting blades for slitting the full-width thick fiber web in a longitudinal direction of the thick fiber web to partial thick fiber webs, wherein the winding section further comprises at least one winding drum for winding the partial thick fiber webs to customer rolls and wherein the cutting device is also configured to cut the partial thick fiber webs when a set of the customer rolls is finished.

3. The slitter-winder of claim 1 wherein the slitter-winder comprises a reject handling system configured to receive the cut part(s) comprising the joint removed from the thick fiber web or from the partial thick fiber webs, the reject handling system comprising a reject opening in the frame positioned beneath the cutting device.

4. The slitter-winder of claim 1, wherein the winding section comprises a two drum winder comprising a front winding drum and a back winding drum and wherein the cutting device is located between the front winding drum and the back winding drum, or the cutting device is located below the front winding drum and the back winding drum, or the cutting device is located in front of the front winding drum.

5. The slitter-winder of claim 1 wherein the joining device is configured to form a form-fitting joint.

6. A method for slitting and winding a fiber web in a slitter-winder comprising an unwinding section, a slitting section and a winding section, the method comprising the steps of:

unwinding a full-width thick fiber web having a basic weight of at least 200 g/m$^2$ in the unwinding section and slitting and winding said thick fiber web into customer roll(s) in slitting and winding sections;

wherein the full-width thick fiber web is alternating unwound in the unwinding section from a parent roll in a first unwinder and from a parent roll in a second unwinder;

wherein a beginning end of a thick fiber web coming from the parent roll in the first unwinder is joined to an end of a thick fiber web coming from the parent roll in the second unwinder by a joining device to form a joint between the beginning end and the end; and cutting the thick fiber web comprising the joint by a cutting device and removing the joint from the winding section automatically.

7. The method of claim 6 wherein the step of cutting the thick fiber web comprising the joint by a cutting device and removing the joint from the winding section automatically comprises:

making a first cut in the joined thick fiber web in a cross-machine direction with the cutting device at a location downstream of the joint; and after making the first cut, making a second cut with the cutting device in the cross-machine direction in the thick fiber web at a location upstream of the joint.

8. The method of claim 6, wherein the fiber web is slit in a longitudinal direction of the thick fiber web to partial thick fiber webs, and wherein the partial thick fiber webs are wound to customer rolls in the winding section which comprises at least one winding drum and wherein the partial thick fiber webs are cut by the cutting device when a set of the customer rolls is finished.

9. The method of claim 8 further comprising a step of jogging the fiber web forward between the cutting for finishing the customer rolls and the cutting of the part(s) of the thick fiber web comprising the joint for removing the part(s) of the thick fiber web comprising the joint.

10. The method of claim 6, wherein the part(s) of the thick fiber web comprising the joint is/are guided through the winding section towards a reject handling system, the reject handling system comprising a reject opening in the frame positioned beneath the cutting device.

11. The method of claim 10, wherein the part(s) comprising the joint (J) is/are cut by the cutting device and removed from the thick fiber web or the partial thick fiber webs to the reject handling system through a reject opening or by a reject conveyor.

12. The method of claim 6, wherein the winding section has at least one winding drum, and wherein the part(s) with the joint (J) is/are guided through the winding section over the at least one winding drum.

13. The method of claim 6 further comprising the steps of:

finishing winding of a finished customer roll set and removing the finished customer roll set from the winder;

changing the unwinding from emptying the parent roll in one of the first unwinder and the second unwinder to a new parent roll in the other of the first underwinder and the second unwinder and joining fiber web ends of the parent roll and the new parent roll; and preparing the winder for next customer roll set winding; and beginning steps for winding of new customer rolls.

14. The method of claim 13 wherein the steps of finishing winding of a finished customer roll set and removing the finished customer roll set from the winder and changing the unwinding from emptying the parent roll in one unwinder to a new parent roll in the other unwinder and joining the fiber web ends are performed simultaneously.

15. The method of claim 13 wherein before finishing winding of a finished customer roll set and removing the finished customer roll set from the winder, the slitter-winder is decelerated to crawling speed or to a stop.

16. The method of claim 13 wherein after the beginning steps for the winding of the new customer rolls, the slitter-winder is accelerated to a running speed.

17. A slitter-winder for fiber webs, wherein the slitter-winder is configured to unwind, slit and wind a thick fiber web having a basic weight of at least 200 g/m$^2$ to customer rolls, the slitter winder comprising:

an unwinding section having a first unwinder and a second unwinder for unwinding the thick fiber web from a parent roll comprising full-width thick fiber web, and a joining device for joining a beginning end of a thick fiber web coming from a parent roll and traveling in a machine direction in the first unwinder to an end of a thick fiber web coming from a parent roll in the second unwinder to form a joint;

a slitting section after the unwinding section; and a winding section having a cutting device for forming a cut extending in a cross-machine direction perpendicular to the machine direction for cutting and removing part(s) of the thick fiber web comprising the joint from the winding section.

18. The slitter-winder of claim 17 wherein the winding section is disposed above a floor level having a downwardly offset floor level part which is located below the floor level and disposed to receive cut part(s) of the thick fiber web comprising the joint.

19. The slitter-winder of claim 17, wherein the winding section comprises a two drum winder comprising a front winding drum and a back winding drum and wherein the cutting device is located between the front winding drum and the back winding drum.

20. The slitter-winder of claim 17, wherein the winding section comprises a two drum winder comprising a front winding drum and a back winding drum and wherein the cutting device is located below the front winding drum and the back winding drum.

* * * * *